US010890411B1

(12) United States Patent
Chen

(10) Patent No.: US 10,890,411 B1
(45) Date of Patent: Jan. 12, 2021

(54) SPRAY NOZZLE

(71) Applicant: Bo Chen, Guangdong (CN)

(72) Inventor: Bo Chen, Guangdong (CN)

(73) Assignee: Shantou P&C Plastic Products Company Limited, Shantou (CN)

( * ) Notice: Subject to any disclaimer, the term of this patent is extended or adjusted under 35 U.S.C. 154(b) by 0 days.

(21) Appl. No.: 16/716,541

(22) Filed: Dec. 17, 2019

(30) Foreign Application Priority Data

Aug. 30, 2019 (CN) ..... 2019 2 1432512 U

(51) Int. Cl.
*F41B 9/00* (2006.01)
*B05B 7/10* (2006.01)

(52) U.S. Cl.
CPC ..... *F41B 9/0075* (2013.01); *B05B 7/10* (2013.01)

(58) Field of Classification Search
CPC ..... F41B 9/0075; B05B 7/10; B05B 1/34–1/3494
USPC ..... 239/589
See application file for complete search history.

(56) References Cited

U.S. PATENT DOCUMENTS 5,836,514 A * 11/1998 Handfield ..... F25C 3/04 239/14.2
2010/0301135 A1* 12/2010 Hunnicutt ..... B05B 3/003 239/222.17
2010/0327081 A1* 12/2010 Martin ..... F23D 11/107 239/403

* cited by examiner

*Primary Examiner* — Chee-Chong Lee
(74) *Attorney, Agent, or Firm* — Mindler Law Group; Willy H. Wong

(57) ABSTRACT

A spray nozzle comprises an outer tube, an inner tube disposed in the outer tube, and a sleeve mounted on the outer tube. A front end of the inner tube protrudes from the outer tube. A partition plate is disposed in the inner tube, the partition plate and the inner tube encircle to form an opened diversion groove with a plurality of notches. The inner tube is disposed with a plurality of guide vanes, a space between the outer tube and the inner tube is divided by the guide vanes into a plurality of diversion cavities communicating with the opened diversion groove through the corresponding notch. The sleeve makes sealing contact with the outer tube, the sleeve is provided with a sealing plate contacting and fitting with the opened diversion groove, and the sealing plate is provided with a water jet hole communicating with the opened diversion groove.

9 Claims, 1 Drawing Sheet

SPRAY NOZZLE

RELATED APPLICATIONS

This application claims benefit of Chinese Patent Application No. CN 201921432512.X, filed Aug. 30, 2019.

The above applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

BACKGROUND OF THE INVENTION

Field of Invention

The present invention relates to a spray component, and more particularly to a spray nozzle.

Related Art

As we all know, toy water guns are toys that children often play in the summer. There are many kinds of children's toy water guns on the market, and the structures are different. At present, most of the existing toy water guns can only stream water, the ejected water flow is columnar. In order to improve the fun and appeal of toy water gun, the water outlet of the toy water gun can be installed with a spray nozzle, so that the water flow ejected by the toy water gun is in spray pattern. However, most of the spray nozzles on the market presently have the following defects: the structure is complicated and the production cost is high; the sprayed water mist covers a small area and is uneven, and the spray effect is so-so.

SUMMARY OF THE INVENTION

One technical problem to be solved by the present invention is to provide a spray nozzle, water mist sprayed by the spray nozzle is uniform, covers a large area and the spray effect is good. The technical solutions adopted are as follows:

One embodiment of a spray nozzle comprises:

an outer tube, the outer tube is disposed along front and rear directions;

an inner tube, the inner tube is disposed in a cavity of the outer tube, and a front end of the inner tube protrudes from a front end opening of the outer tube; and a sleeve, the sleeve is mounted on an outer side of the outer tube;

a partition plate is disposed in a cavity of the inner tube, the partition plate and an inner wall of the front end of the inner tube together encircle to form an opened diversion groove;

a groove wall of the opened diversion groove is disposed with a plurality of notches;

an outer side surface of the inner tube is disposed with a plurality of guide vanes arranged along a circumferential direction of the inner tube;

an outer edge of each of the guide vanes contacts and fits with an inner side surface of the outer tube;

a space between the outer tube and the inner tube is divided by each of the guide vanes into a plurality of diversion cavities along front and rear directions, each of the diversion cavities respectively communicates with a cavity of the opened diversion groove through the corresponding notch;

an inner side surface of the sleeve makes sealing contact with an outer side surface of the outer tube;

a front end of the sleeve is provided with a sealing plate; and a rear side surface of the sealing plate contacts and fits with a groove opening edge of the opened diversion groove, the sealing plate is provided with a water jet hole, and the water jet hole communicates with the groove opening of the opened diversion groove.

In one embodiment of the above-mentioned spray nozzle, a rear end opening of the outer tube forms a water inlet of the spray nozzle, and the water jet hole on the sealing plate forms a water outlet of the spray nozzle.

When in use, one embodiment of the spray nozzle can be installed on a water outlet pipe of a toy water gun, and the rear end of the outer tube communicates with a cavity of the water outlet pipe. When the toy water gun transports water to the spray nozzle through the water outlet pipe, the water transported by the toy water gun enters each of the diversion cavities through the water outlet pipe and the rear end opening of the outer tube, and then enters the opened diversion groove from the corresponding notches respectively to form a plurality of water currents with different flow directions, and the water currents are directly sprayed through the water jet hole on the sealing plate. Thereby effectively increasing a chance of collision between the water currents and an inner wall of the water jet hole. After the water currents with different flow directions collide with the inner wall of the water jet hole, the water currents can be uniformly sprayed around through the water jet hole to realize the spray effect, the sprayed water mist is uniform and covers a large area, and the spray effect is good.

In one embodiment, a sealing ring is fixedly mounted on the outer side surface of the outer tube, and the outer side surface of the outer tube makes sealing contact with the inner side surface of the sleeve through the sealing ring.

In one embodiment, a cross-sectional area of a front end opening of the water jet hole gradually increases from rear to front. Such an adopted structure is capable of preventing the inner wall of the front end of the water jet hole from hindering spraying of the water mist to the surrounding, further ensuring that the sprayed water mist is uniform and covers a large area, and the spray effect is good.

In one embodiment, the sleeve and the outer tube are detachably connected, the sleeve and the outer tube are firmly combined with each other by connection, and the detachable connection facilitates installation and detachment of the spray nozzle.

In one embodiment, the outer side surface of the rear end of the outer tube is provided with an external thread, and the inner side surface of a rear end of the sleeve is provided with an internal thread to match with the external thread on the rear end of the outer tube. The internal thread on the sleeve is embedded in the external thread on the outer tube or separated from the external thread on the outer tube by rotating the sleeve to achieve installing or disassembling the sleeve, and the operation is simple and convenient.

Front and rear mentioned in this specification respectively refer to: a direction of transporting water along the water outlet pipe of the toy water gun to the spray nozzle, with the rear referring to the portion where the water first arrives, and with the front referring to the portion where the water finally arrives.

Through the cooperation between the sleeve, the outer tube and the inner tube, the spray nozzle of the present invention not only has a simple structure, but also reduces the production cost, and is capable of making the sprayed water mist uniform with a large area covered, and the spray effect is good.

DETAILED DESCRIPTION OF THE INVENTION

Figure 1:
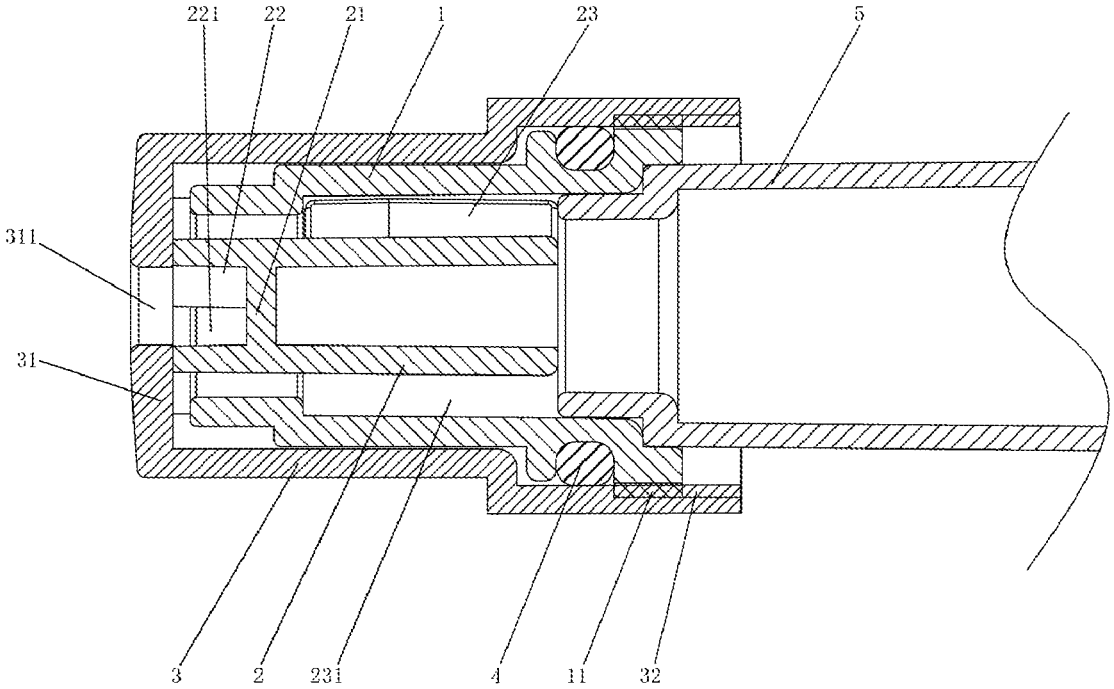
FIG. 1 is a schematic view of the structure of a spray nozzle according to one embodiment of the present invention.
Figure 2:
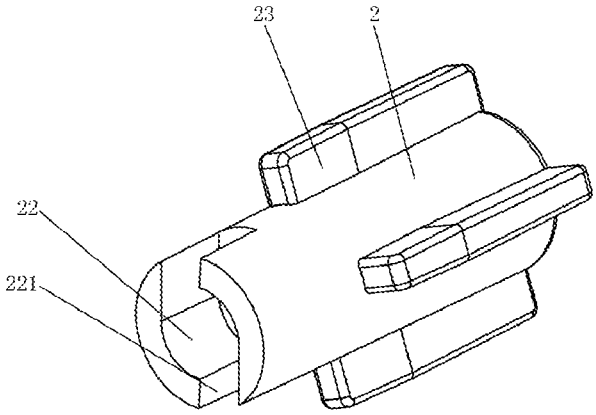
FIG. 2 is a perspective view of the structure of an inner tube in the spray nozzle shown in FIG. 1.

As shown in FIG. 1 and FIG. 2, one embodiment of a spray nozzle comprises an outer tube 1, an inner tube 2 and a sleeve 3. The outer tube 1 is disposed along front and rear directions, the inner tube 2 is disposed in a cavity of the outer tube 1, and a front end of the inner tube 2 protrudes from a front end opening of the outer tube 1. A partition plate 21 is disposed in a cavity of the inner tube 2, the partition plate 21 and an inner wall of the front end of the inner tube 2 together encircle to form an opened diversion groove 22, and a groove wall of the opened diversion groove 22 is disposed with a plurality of notches 221. An outer side surface of the inner tube 2 is disposed with a plurality of guide vanes 23 arranged along a circumferential direction of the inner tube 2, an outer edge of each of the guide vanes 23 contacts and fits with an inner side surface of the outer tube 1, a space between the outer tube 1 and the inner tube 2 is divided by each of the guide vanes 23 into a plurality of diversion cavities 231 along front and rear directions, and each of the diversion cavities 231 respectively communicates with a cavity of the opened diversion groove 22 through the corresponding notch 221. The sleeve 3 is mounted on an outer side of the outer tube 1, an inner side surface of the sleeve 3 makes sealing contact with an outer side surface of the outer tube 1, and a front end of the sleeve 3 is provided with a sealing plate 31. A rear side surface of the sealing plate 31 contacts and fits with a groove opening edge of the opened diversion groove 22, the sealing plate 31 is provided with a water jet hole 311, and the water jet hole 311 communicates with the groove opening of the opened diversion groove 22.

In this embodiment, a sealing ring 4 is fixedly mounted on the outer side surface of the outer tube 1, and the outer side surface of the outer tube 1 makes sealing contact with the inner side surface of the sleeve 3 through the sealing ring 4.

In this embodiment, a cross-sectional area of a front end opening of the water jet hole 311 gradually increases from rear to front.

In this embodiment, the outer side surface of the rear end of the outer tube 1 is provided with an external thread 11, and the inner side surface of a rear end of the sleeve 3 is provided with an internal thread 32 to match with the external thread 11.

The following briefly describes the working principle of one embodiment of the spray nozzle:

When in use, one embodiment of the outer tube 1 of the spray nozzle can be installed on a front end of a water outlet pipe 5 of a toy water gun. When the toy water gun transports water to the spray nozzle through the water outlet pipe 5, the water transported by the toy water gun enters each of the diversion cavities 231 through the water outlet pipe 5 and a rear end opening of the outer tube 1, and then enters into the opened diversion groove 22 from the corresponding notches 221 respectively to form a plurality of water currents with different flow directions, and the water currents are directly sprayed through the water jet hole 311 on the sealing plate 31. After the water currents with different flow directions collide with the inner wall of the water jet hole 311, the water currents can be uniformly sprayed around through the water jet hole 311 to realize the spray effect.

In addition, it should be explained that each of the part names of the specific embodiments described in the specification can be named differently, equivalent or simple changes made according to the structures, features and principles described in the concept of the present invention still fall within the scope covered by the technical solutions of the present invention. Technical personnel skilled in the art to which the present invention pertains can make various modifications or additions to the specific embodiments described or replace them in a similar manner, which still fall within the protection scope of the present invention as long as they do not depart from the structures of the present invention or are not beyond the scope defined by the appended claims.

LIST OF REFERENCED PARTS outer tube 1
external thread 11
inner tube 2
partition plate 21
opened diversion groove 22
notch 221
guide vane 23
diversion cavity 231
sleeve 3
sealing plate 31
water jet hole 311
internal thread 32
sealing ring 4
water outlet pipe 5

What is claimed is:

1. A spray nozzle comprising:

an outer tube, the outer tube being disposed along front and rear directions;

an inner tube, the inner tube being disposed in a cavity of the outer tube, and a front end of the inner tube protruding from a front end opening of the outer tube;

a sleeve, the sleeve being mounted on an outer side of the outer tube;

a partition plate being disposed in a cavity of the inner tube, the partition plate and an inner wall of the front end of the inner tube together encircling to form an opened diversion groove;

a groove wall of the opened diversion groove being disposed with a plurality of notches;

an outer side surface of the inner tube being disposed with a plurality of guide vanes arranged along a circumferential direction of the inner tube;

an outer edge of each of the plurality of guide vanes contacting and fitting with an inner side surface of the outer tube;

a space between the outer tube and the inner tube being divided by each of the plurality of guide vanes into a plurality of diversion cavities along front and rear directions, each of the plurality of diversion cavities respectively communicating with a cavity of the opened diversion groove through the corresponding notch;

an inner side surface of the sleeve making sealing contact with an outer side surface of the outer tube;

a front end of the sleeve being provided with a sealing plate; and a rear side surface of the sealing plate contacting and fitting with a groove opening edge of the opened diversion groove, the sealing plate being provided with a water jet hole, the water jet hole communicating with a groove opening of the opened diversion groove.

2. The spray nozzle as claimed in claim 1, wherein a sealing ring is fixedly mounted on the outer side surface of the outer tube, and the outer side surface of the outer tube makes sealing contact with the inner side surface of the sleeve through the sealing ring.

3. The spray nozzle as claimed in claim 2, wherein the sleeve and the outer tube are detachably connected.

4. The spray nozzle as claimed in claim 3, wherein the outer side surface of a rear end of the outer tube is provided with an external thread, and the inner side surface of a rear end of the sleeve is provided with an internal thread to match with the external thread on the rear end of the outer tube.

5. The spray nozzle as claimed in claim 1, wherein a cross-sectional area of a front end opening of the water jet hole gradually increases from rear to front.

6. The spray nozzle as claimed in claim 5, wherein the sleeve and the outer tube are detachably connected.

7. The spray nozzle as claimed in claim 6, wherein the outer side surface of a rear end of the outer tube is provided with an external thread, and the inner side surface of a rear end of the sleeve is provided with an internal thread to match with the external thread on the rear end of the outer tube.

8. The spray nozzle as claimed in claim 1, wherein the sleeve and the outer tube are detachably connected.

9. The spray nozzle as claimed in claim 8, wherein the outer side surface of a rear end of the outer tube is provided with an external thread, and the inner side surface of a rear end of the sleeve is provided with an internal thread to match with the external thread on the rear end of the outer tube.

* * * * *